US005339777A

United States Patent [19]

Cannon

[11] Patent Number: 5,339,777

[45] Date of Patent: Aug. 23, 1994

[54] ELECTROHYDRAULIC DEVICE FOR ACTUATING A CONTROL ELEMENT

[75] Inventor: Howard N. Cannon, Peoria, Ill.

[73] Assignee: Caterpillar Inc., Peoria, Ill.

[21] Appl. No.: 106,726

[22] Filed: Aug. 16, 1993

[51] Int. Cl.[5] ..... F01L 9.02

[52] U.S. Cl. ..... 123/90.12; 123/90.11; 137/625.65

[58] Field of Search ..... 123/90.11, 90.12; 137/625.65; 251/129.16

[56] References Cited

U.S. PATENT DOCUMENTS

| | | | |
|---|---|---|---|
| 3,743,898 | 7/1973 | Sturman | 317/154 |
| 3,882,833 | 5/1975 | Longstaff et al. | 123/90.11 |
| 4,144,514 | 3/1979 | Rinde et al. | 335/229 |
| 4,515,343 | 5/1985 | Pischinger et al. | 251/48 |
| 4,681,143 | 7/1987 | Sato et al. | 137/625.37 |
| 4,791,895 | 12/1988 | Tittizer | 123/90.12 |
| 4,829,947 | 5/1989 | Lequesne | 123/90.11 |
| 4,841,923 | 6/1989 | Buchl | 123/90.11 |
| 4,873,948 | 10/1989 | Richeson et al. | 123/90.11 |
| 4,878,464 | 11/1989 | Richeson et al. | 123/90.11 |
| 4,883,025 | 11/1989 | Richeson | 123/90.11 |
| 4,886,091 | 12/1989 | Coleman | 137/625.65 |
| 4,899,785 | 2/1990 | Inokuchi | 137/625.65 |
| 4,974,495 | 12/1990 | Richeson | 91/459 |
| 5,022,358 | 6/1991 | Richeson | 123/90.12 |
| 5,074,259 | 12/1991 | Pusic | 123/90.11 |
| 5,080,323 | 1/1992 | Kreuter | 251/129.1 |
| 5,095,856 | 3/1992 | Kawamura | 123/90.11 |
| 5,108,070 | 4/1992 | Tominaga | 137/625.65 |
| 5,109,812 | 5/1992 | Erickson et al. | 123/90.12 |
| 5,113,896 | 5/1992 | Tortellier | 137/269 |
| 5,117,213 | 5/1992 | Kreuter et al. | 335/219 |
| 5,131,624 | 7/1992 | Kreuter et al. | 251/129.18 |
| 5,152,260 | 10/1992 | Erickson et al. | 123/90.12 |
| 5,178,359 | 1/1993 | Stobbs et al. | 251/30.02 |
| 5,190,013 | 3/1993 | Dozier | 123/481 |
| 5,199,392 | 4/1993 | Kreuter et al. | 123/90.11 |
| 5,224,683 | 7/1973 | Richeson | 123/90.12 |
| 5,253,619 | 10/1993 | Richeson et al. | 123/90.12 |
| 5,259,345 | 11/1993 | Richeson | 123/90.12 |
| 5,284,220 | 2/1994 | Shimizu et al. | 137/625.65 |
| 5,287,829 | 2/1994 | Rose | 123/90.12 |

*Primary Examiner*—E. Rollins Cross
*Assistant Examiner*—Weilun Lo
*Attorney, Agent, or Firm*—David M. Masterson

[57] ABSTRACT

An electrohydraulic assembly for actuating a moveable control element is provided. A valve body has two fluid ports, and a central bore. A core is disposed in spaced proximity from the valve body. An armature is rectilinearly translatable between first and second positions relative to the core. First and second electromagnetic coils produce respective electromagnetic forces in response to being energized to cause the rectilinear movement of the armature. A linearly shiftable spool is rigidly connected to the armature. The armature movement causes the spool to displace, which controls fluid flow for actuating the control element. First and second springs provide respective biasing forces to the armature to assist the rectilinear movement of the armature upon the appropriate energization of either of the electromagnetic coils. Advantageously, the retentivity of the core, armature and valve body causes a high latching force to latch the armature at either of the armature positions in response to a respective electromagnetic coil being de-energized.

7 Claims, 6 Drawing Sheets

ELECTROHYDRAULIC DEVICE FOR ACTUATING A CONTROL ELEMENT

DESCRIPTION

1. Technical Field

This invention relates generally to an electrohydraulic device for actuating a control element and, more particularly, to an electrohydraulic device for actuating a control element of an internal combustion engine.

2. Background Art

Control of internal combustion engines has received substantial attention in the past several decades. Compression and spark ignition engine designs have attempted to achieve increased flexibility of engine operation. A plethora of engine designs have been directed to independent intake and exhaust valve actuation and electronic fuel injection. Engines using independent valve actuation and electronic fuel injection have been conceived to perform engine operation modes not attainable by cam-based engines.

The above engines that use independent valve actuation and electronic fuel injection employ several designs for valve and injection actuation. The most common designs use bi-directional solenoids that provide the muscle to actuate an engine valve. The bi-directional solenoid is bistable between two positions and can open and close a gas exchange valve of an internal combustion engine in a rapid manner.

Internal combustion engine valves are almost universally of a popper type which are spring loaded to a valve-closed position and opened against the spring bias. To achieve the desired fast response times, prior art bi-directional solenoid designs include either a spring or pneumatic assembly to store potential energy while the solenoid is bi-stable in one position and immediately release that energy to perform a subsequent actuation in the other bi-stable position. Such prior art designs of this type include: U.S. Pat. Nos. 4,883,025; 5,080,323; 5,117,213; 5,131,624; and 5,199,392. Unfortunately one common problem to each of these designs relates to the use of spring biasing elements or permanent magnet elements to provide the energy to latch the solenoid in one of the bi-stable positions. These type of latching elements complicates the mechanism and generally necessitates an increase in the size of the bi-directional solenoid.

One problem pertaining to the use of permanent magnets relates to an inefficient energy use of the solenoid. For example, a substantial amount of energy is required to de-latch the armature from the permanent magnet. This de-latching energy is far greater than the energy required to move the armature once it is de-latched. Thus, expensive electromagnetic circuitry is needed to provide the requisite de-latching energy.

Another problem pertains to the material property of the permanent magnet. Permanent magnets tend to be brittle and are easily chipped. Consequently permanent magnets should not be used as the pole faces of the solenoid, but instead must be "buried" in another part of the magnetic circuit. This characteristic requires a substantial increase in a number of parts making up the magnetic circuit, thereby increasing manufacturing costs, assembly time and tolerance accumulation.

The present invention is directed to overcoming one or more of the problems as set forth above.

DISCLOSURE OF THE INVENTION

In one aspect of the present invention, an electrohydraulic assembly for actuating a moveable control element is provided. A valve body has two fluid ports, and a central bore. A core is disposed in spaced proximity from the valve body. An armature is rectilinearly translatable between first and second positions relative to the core. First and second electromagnetic coils produce respective electromagnetic forces in response to being energized to cause the rectilinear movement of the armature. A linearly shiftable spool is rigidly connected to the armature. The armature movement causes the spool to displace, which controls fluid flow for actuating the control element. First and second springs provide respective biasing forces to the armature to assist the rectilinear movement of the armature upon the appropriate energization of either of the electromagnetic coils. Advantageously, the retentivity of the core, armature and valve body causes a high latching force to latch the armature at either of the armature positions in response to a respective electromagnetic coil being de-energized.

BRIEF DESCRIPTION OF THE DRAWINGS

For a better understanding of the present invention, reference may be made to the accompanying drawings in which.

BEST MODE FOR CARRYING OUT THE INVENTION

Figure 1:
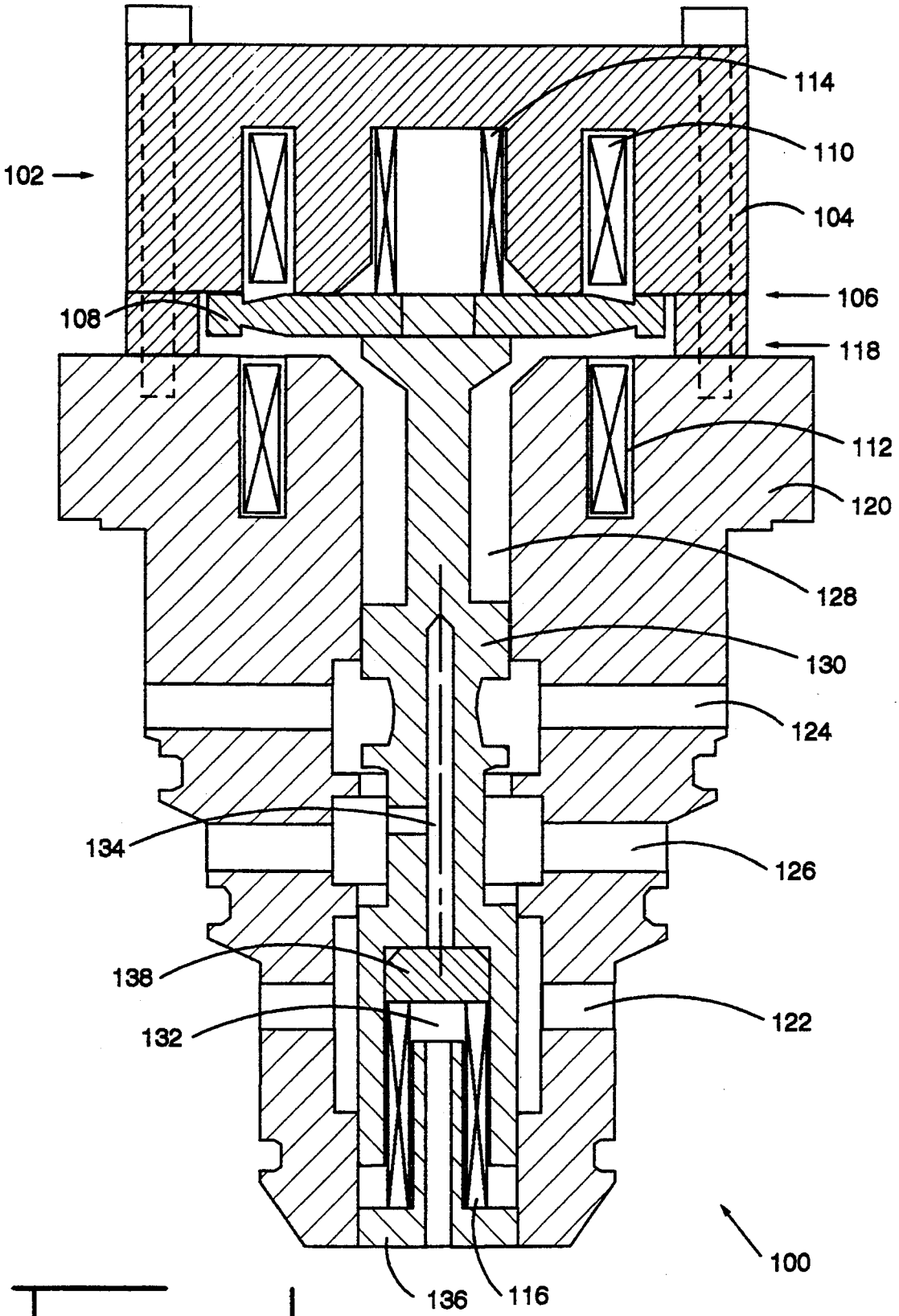
FIG. 1 shows a cross sectional view of a preferred electrohydraulic valve associated with the present invention.

Referring now to the drawings, wherein a preferred embodiment of the present invention is shown, FIG. 1 illustrates an electrohydraulic valve 100. The electrohydraulic valve 100 includes of a bidirectional solenoid 102. The solenoid 102 has a core 104 that defines a pole face 106. An armature 108 is rectilinearly translatable between first and second positions relative to the core 104. First and second electromagnetic coils 110,112 provide electromagnetic forces in response to being energized. The electromagnetic forces cause the armature 108 to move between the first and second positions. First and second springs 114,116 provide respective biasing forces to the armature. For example, the biasing forces assist the rectilinear movement of the armature 108 upon the appropriate energization of either of the electromagnetic coils 110,112.

The armature 108 is shown in the first position. To position the armature 108 to the first position, the first coil 110 is energized by a magnetizing current that creates an electromagnetic force that causes the armature 108 to move toward the pole face 106. The armature movement toward the pole face 106 causes the first spring 114 to compress. Once the armature 108 engages the pole face 106, the first coil 110 is de-energized.

When the first coil 110 is de-energized, a portion of the magnetic energy is retained in the magnetic circuit created by the armature 108 and pole face 106. Since essentially no air gap exists between the armature 108 and pole face (due to the flatness exhibited by the armature and pole face), a high "latching force" is created via residual magnetism to latch the armature 108 to the pole face 106 long after the first coil 110 is de-energized. Advantageously, the latching force is created without the aid of permanent magnets.

To move the armature 108 from the first position to the second position, the second coil 112 is energized by a magnetizing current subsequent to the first coil 110 being energized by a de-magnetizing current (a current opposite in polarity to the magnetizing current). The spring force of the compressed spring 114 overcomes the now decaying latching force between the armature 108 and pole face 106, and accelerates the armature 108 toward the valve body 120. The electromagnetic force of the second coil 112 coerces the armature 108 against the valve body pole face 118, which results in compression of the second spring 116. The second coil 112 is then de-energized and the residual magnetism between the armature 108 and pole face 118 creates a high latching force to maintain the armature 108 at the second position.

Preferably the core 104, armature 108, and valve body 120 are fabricated of soft magnetic material. The term soft magnetic material is used to distinguish from materials commonly used for permanent magnets as is well known in the art.

The valve body 120 includes a fluid supply port 122, a fluid exhaust port 124 and a control port 126. The valve body 120 defines a central bore 128. A linearly shiftable spool 130 is disposed in the central bore 128 and is rigidly connected to the armature 130. The spool 130 defines a chamber 132 and a passage 134 that communicates the control port 126 to the chamber 132.

The valve body 120 includes an end plug 136 that is disposed in the central bore 128 at an end of the valve body 120. The second spring 116 is disposed in the chamber 132 and adjacent to the end plug 116. Additionally, a popper plug 138 is disposed in the chamber 132 and is spring biased against the spool 130.

Thus, while the present invention has been particularly shown and described with reference to the preferred embodiment above, it will be understood by those skilled in the art that various additional embodiments may be contemplated without departing from the spirit and scope of the present invention.

Industrial Applicability

The present invention is particularly suited to actuate a moveable element of an internal combustion engine. FIGS. 2–6 illustrate the relationship of the electrohydraulic valve 100 to a conventional internal combustion engine valve 202, which is commonly referred to as a gas exchange valve. The electrohydraulic valve 100 controls the flow of hydraulic fluid to open and close the engine valve 202. Although the present invention is discussed with reference to the control of an engine valve, it may become apparent to those skilled in the art that the present invention may be used in a variety of other engine applications such as the control of a needle valve for a fuel injector, for example. Further the present invention may additionally be used for other applications, such as transmission control applications. For example, the present invention may be used in the form of a digital valve to control the filling of an electronic clutch.

Figure 2:
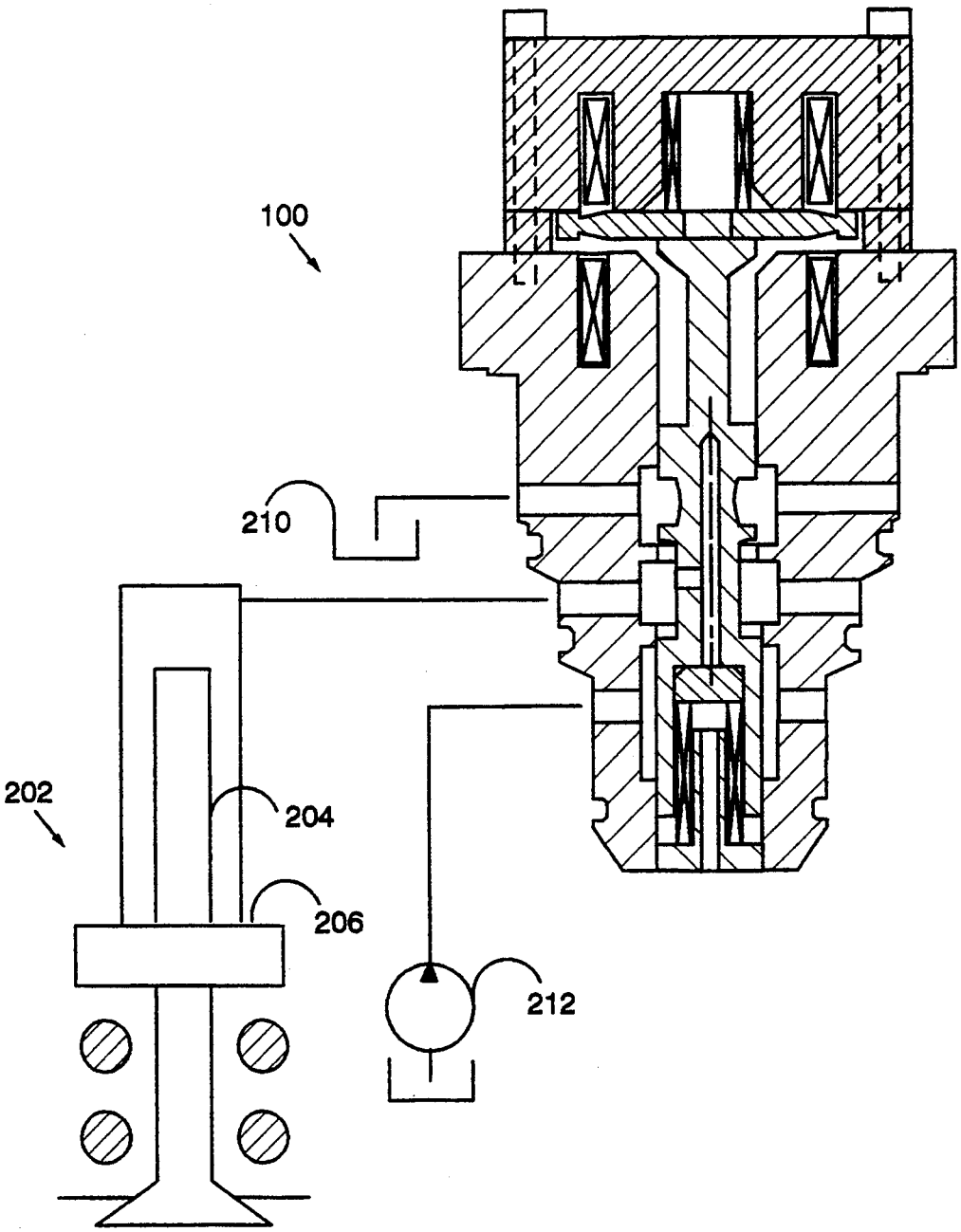
FIGS. 2–6 show the preferred electrohydraulic valve at various operational positions to achieve actuation of an engine valve.
Figure 3:
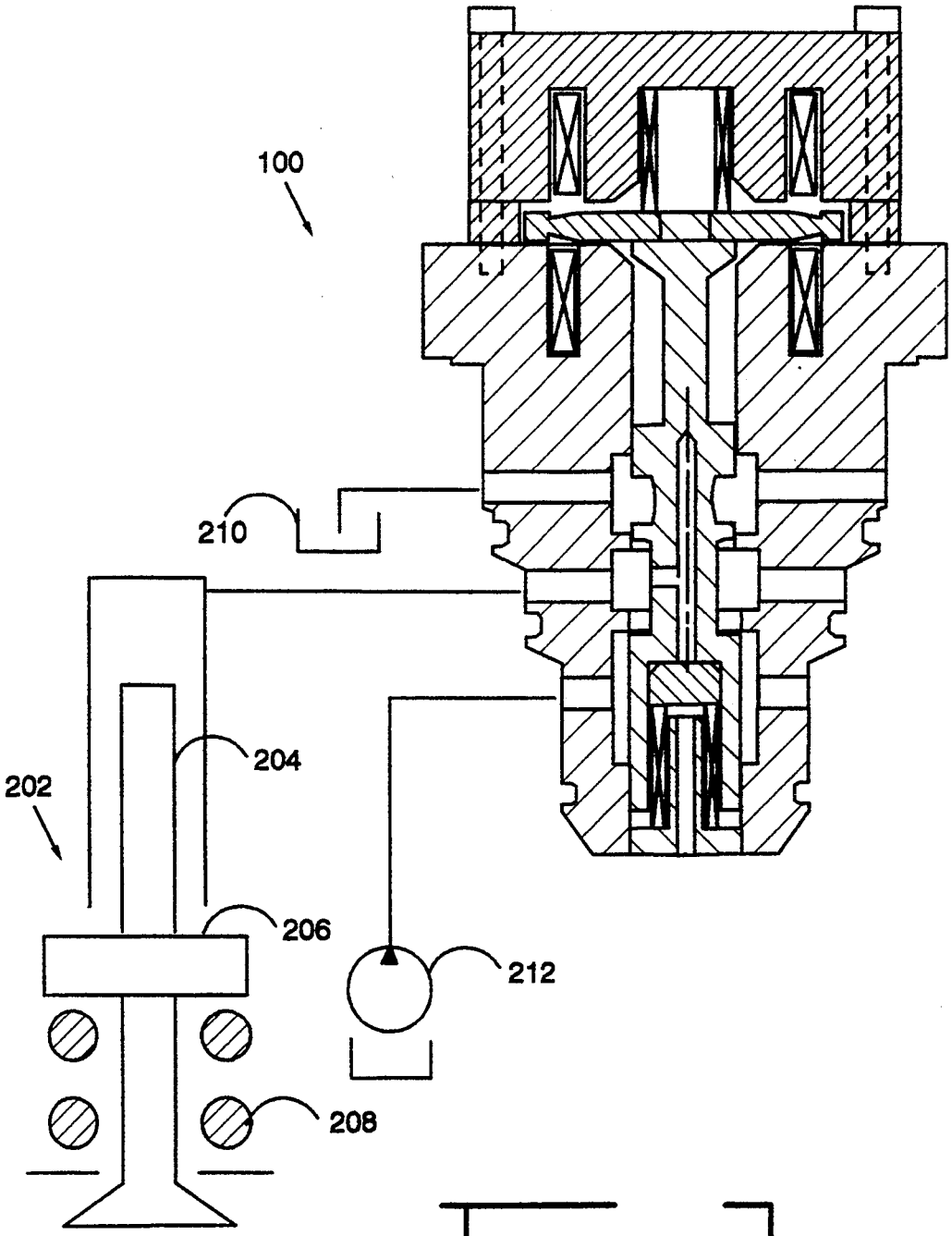

Referring now to FIG. 2, an engine valve 202 as shown is shown in the closed or seated position. The engine valve includes an elongated stem 204 and a plate 206. A valve spring 208 biases the plate 206 to maintain the engine valve 202 at the closed position in the absence of fluid pressure acting on the valve stem 204. For example to move the engine valve 202 to the seated piston, the electrohydraulic valve 100 must be actuated to the first position to allow hydraulic fluid to travel from the engine valve 202 to the tank 210. However to open the engine valve 202, the electrohydraulic valve 100 must be actuated to the second position (as shown in FIG. 3), to allow hydraulic fluid to travel from the pump 212 to the engine valve 202. Resultantly the hydraulic fluid applies an axial force to the valve stem 204 and forces the engine valve 202 to the open position.

Advantageously, the present invention provides for a safety feature to prevent the engine valve 202 from being damaged by an engine piston. For example if the solenoid portion 102 of the hydraulic valve 100 fails while the electrohydraulic valve 100 is in the second position, the valve spring 208 would not have enough force to overcome the fluid force acting on the valve stem 204. Thus if the engine valve 202 is not allowed to close, multiple piston strikes on the engine valve 202 would permanently damage the engine valve 202.

Figure 4:
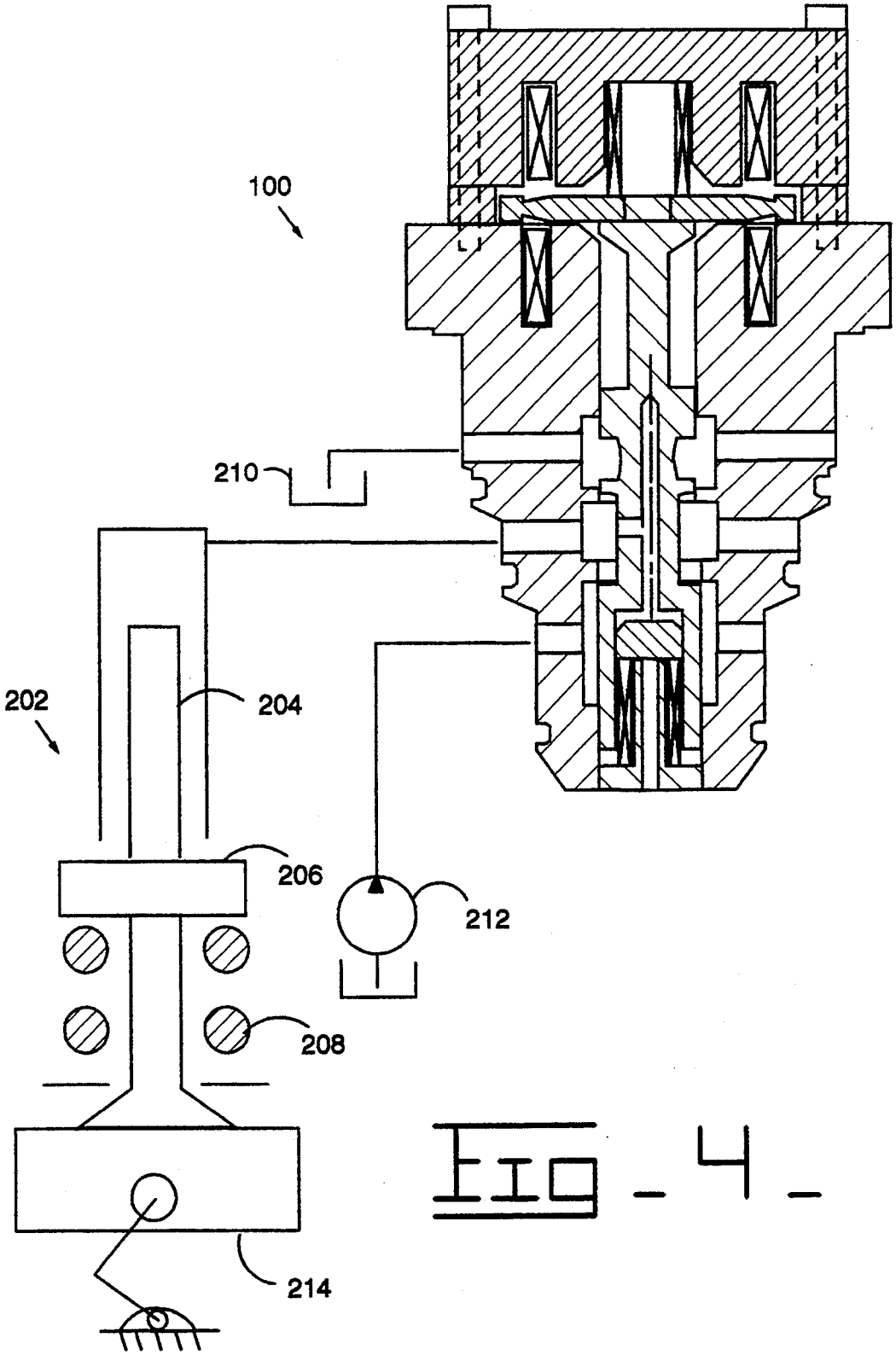
Figure 5:
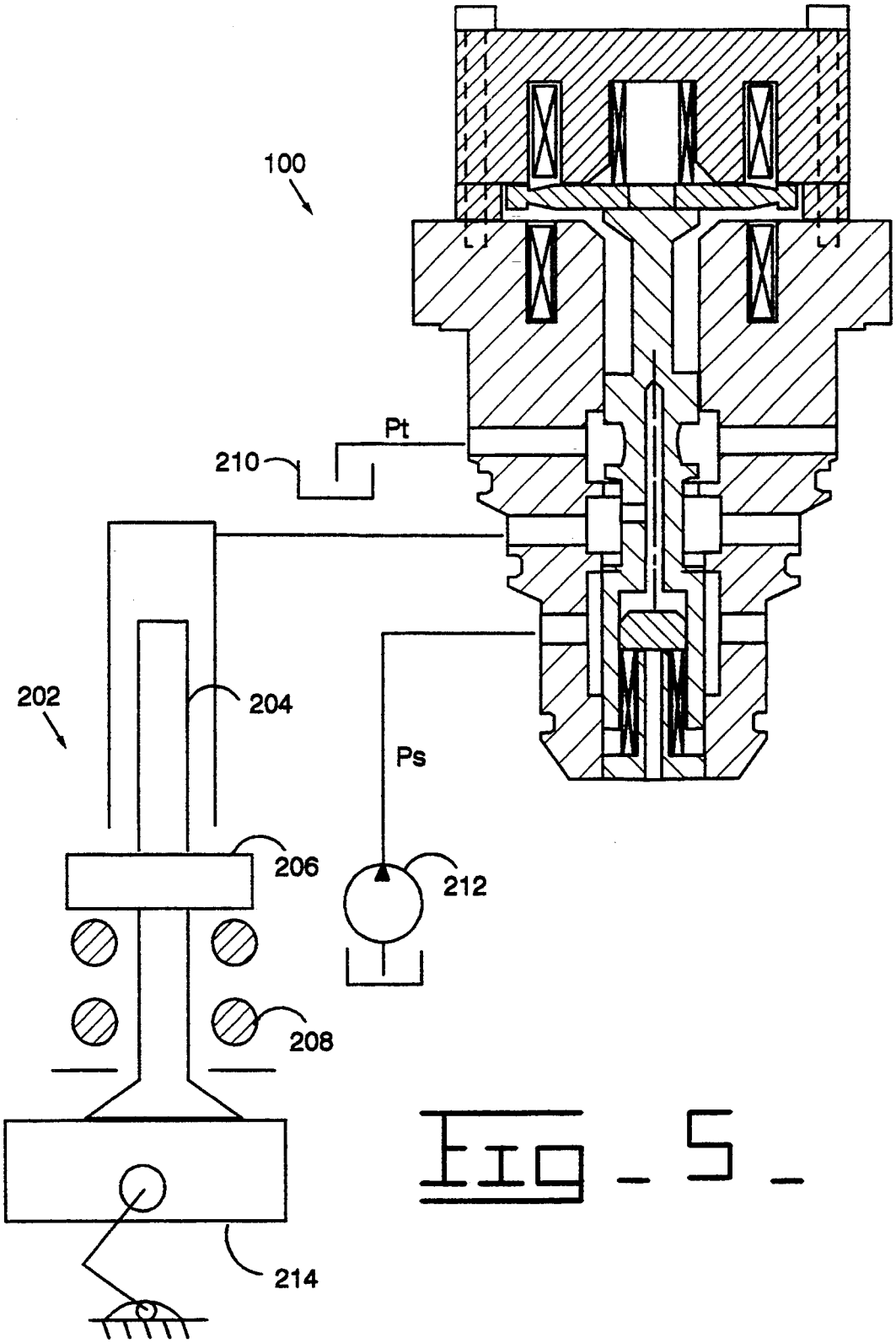
Figure 6:
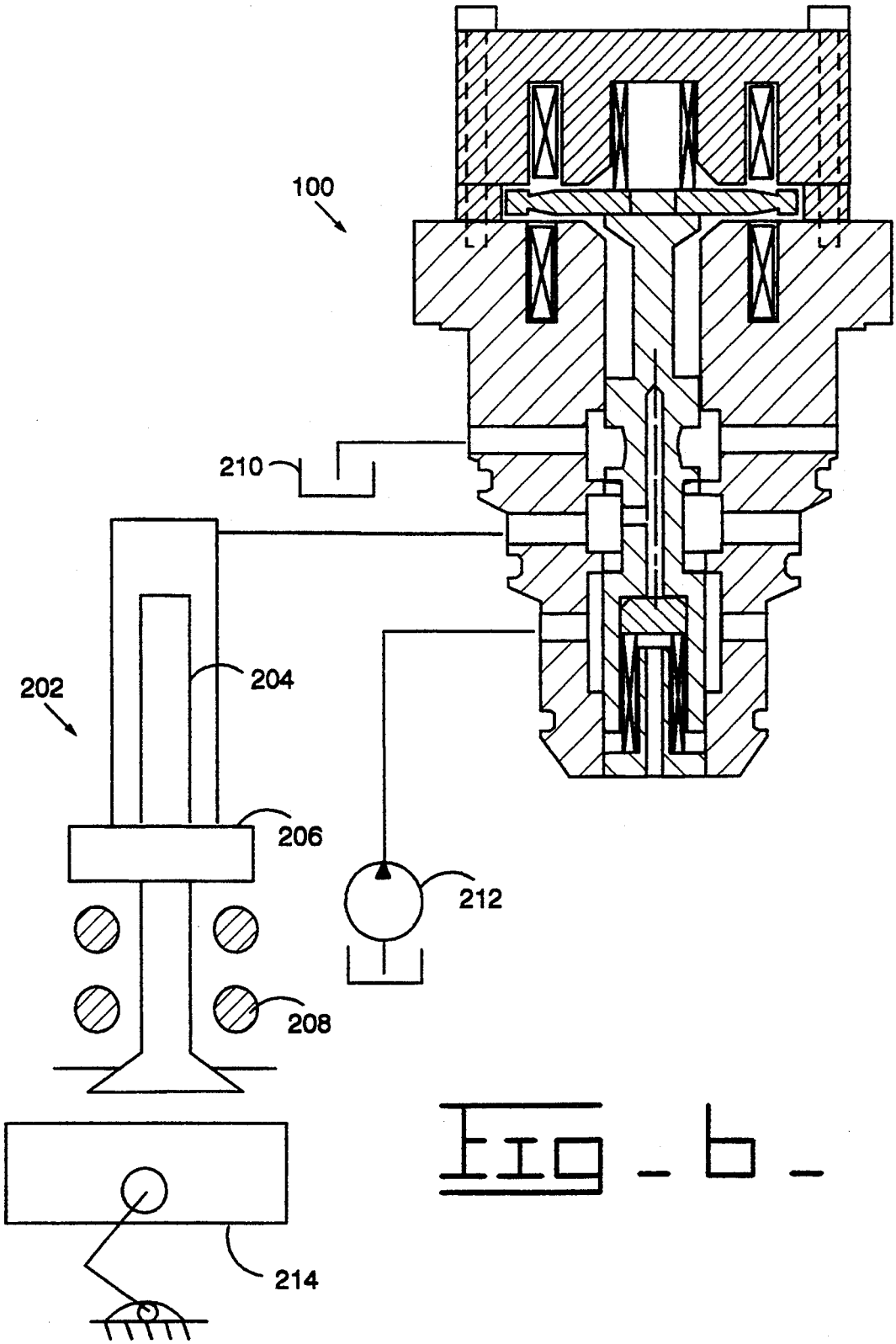

Referring now to FIG. 4, we will assume that the solenoid portion 102 has failed and the electrohydraulic valve 100 is "stuck" in the second position. When a piston 214 strikes the engine valve 202 a high fluid pressure travels from the engine valve 202 to the popper plug 138 via the spool passage 134. As shown in FIG. 5, the high fluid pressure forces the popper plug 138 away from the spool 130, which exposes an end of the spool 130 to the high fluid pressure. Consequently, the high fluid pressure applies an axial force to the end of the spool 130, which displaces the spool 130 such that the tank port 124 opens to the control port 126 and the supply port 122 closes to the control port 126. Thus the engine valve 202 may move to the closed position. Additionally the armature 108 is de-latched from the pole face 118 so that the springs 114,116 can bias the spool 130 to a neutral position, as shown in FIG. 6.

Other aspects, objects and advantages of the present invention can be obtained from a study of the drawings, the disclosure and the appended claims.

I claim:

1. An electrohydraulic assembly for actuating a moveable control element, comprising:

a valve body having two fluid ports and a central bore, the valve body defining a pole face at one end;

a core defining a pole face that is in spaced proximity from the valve body pole face;

an armature being disposed in the space between said core and valve body, said armature being rectilinearly translatable between first and second positions relative to said core, said armature and core pole face having cooperatively disposed surfaces that result in a substantially zero air gap in response to the first armature position, said armature and valve body pole face having cooperatively disposed surfaces that result in a substantially zero air gap in response to the second armature position, said valve body, core and armature being fabricated of a soft magnetic material;

first and second electromagnetic coils for producing respective electromagnetic forces in response to being energized, the electromagnetic forces causing rectilinear movement of said armature;

a linearly shiftable spool being disposed in the central bore of said valve body and rigidly connected to said armature, the movement of said armature causing displacement of said spool to control the fluid flow to the control element to actuate the control element between first and second positions; and first and second springs for providing respective biasing forces to said armature, the biasing forces assisting the rectilinear movement of said armature upon the appropriate energization of either of said electromagnetic coils, wherein the retentivity of the magnetic material of said valve body, core and armature causes a high latching force to latch said armature at either of the armature positions in response to the respective electromagnetic coil being de-energized.

2. A device, as set forth in claim 1, including means for positioning the control element from the second position to the first position in response to inoperability of one of said electromagnetic coils.

3. A device, as set forth in claim 1, wherein said valve body has a fluid supply port, a fluid exhaust port and a control port, and wherein said spool defines a chamber and a passage that communicates the control port to the chamber.

4. A device, as set forth in claim 3, including:

a fluid source for supplying fluid to the fluid supply port; and an end plug being disposed in the central bore at an end of said valve body, said second spring being disposed in the spool chamber and adjacent to said end plug.

5. A device, as set forth in claim 4, including a poppet plug being disposed in the spool chamber adjacent said second spring, said second spring biasing said popper plug against said spool.

6. A device, as set forth in claim 5, wherein the control element includes an engine poppet valve with an elongated stem, the second armature position causing the spool to displace such that fluid flows from the fluid source to the engine valve, the fluid applying an axial force to the valve stem to move the engine valve to an open position.

7. A device, as set forth in claim 6, including an engine piston, said piston striking the open engine valve causing a high fluid pressure to travel from the engine valve through the spool passage to the poppet plug, the high fluid pressure forcing the poppet plug away from the spool exposing the spool to the high fluid pressure, thereby displacing said spool to reduce the fluid pressure imposed on the valve stem resulting the engine valve to close.

* * * * *